US005288245A

United States Patent [19]

Piana et al.

[11] Patent Number: 5,288,245

[45] Date of Patent: Feb. 22, 1994

[54] ELECTRIC CABLE TERMINAL WITH BUILT-IN MARKING SUPPORT

[75] Inventors: Ivana Piana; Silvano Piana, Genoa, Italy

[73] Assignee: Grafoplast S.p.A., Italy

[21] Appl. No.: 916,729

[22] Filed: Jul. 22, 1992

[30] Foreign Application Priority Data

Feb. 28, 1992 [IT] Italy ..... GE92U000013

[51] Int. Cl.[5] ..... H01R 3/00

[52] U.S. Cl. ..... 439/491; 439/879

[58] Field of Search ..... 439/491, 488, 874, 879, 439/882, 910, 489, 870, 880, 882, 933

[56] References Cited

U.S. PATENT DOCUMENTS

| | | | |
|---|---|---|---|
| 2,592,788 | 4/1952 | Branson | 439/491 |
| 4,764,126 | 8/1988 | Piana et al. | 439/491 |
| 4,861,280 | 8/1989 | Piana et al. | 439/491 |
| 5,137,478 | 8/1992 | Graf et al. | 439/932 |

FOREIGN PATENT DOCUMENTS

| | | | |
|---|---|---|---|
| 0251054 | 1/1988 | European Pat. Off. . | |
| 0295543 | 12/1988 | European Pat. Off. . | |
| 3107083 | 3/1982 | Fed. Rep. of Germany . | |
| 1321537 | 2/1963 | France . | |
| 2232016 | 11/1990 | United Kingdom | 439/910 |

*Primary Examiner*—Gary F. Paumen
*Assistant Examiner*—Hien D. Vu
*Attorney, Agent, or Firm*—Rosenman & Colin

[57] ABSTRACT

A terminal includes a metal part, one end of which is to be connected to a binding post of electrical equipment, and the other end of which is shaped as a ring with an insulating coating. A sleeve mounted inside this insulating coating has an extension in which a plurality of marking elements are received. The sleeve and its extension are directly molded on the terminal.

15 Claims, 2 Drawing Sheets

ELECTRIC CABLE TERMINAL WITH BUILT-IN MARKING SUPPORT

BACKGROUND OF THE INVENTION

Terminals for connecting electric cables or leads to the binding post of various electric control and operating units are generally known. These terminals essentially consist of a conductive metal element having a sleeve or lug at one end and a connecting device at the other end. The sleeve is wrapped in insulating material, usually opaque plastic and receives one end of the lead. This sleeve is properly deformed so as to pinch the lead and prevent it from slipping out. The end of the joint or connector to the terminal of the equipment may be shaped according to need, for instance as a ring, fork or plug, male-female (called "Faston") and so on.

There are known for instance terminals according to FR-A-1321537 and EP-A-029554, in which the terminal is manufactured in separate elements to be assembled. There are also known terminals, according to EP-A-0251054, which is formed by a metallic element wrapped in insulating material presenting a support for the marking device and according to DE-A-3107083, which presents a marking support inserted by clutch on the insulating material.

In this application we refer to the known terminals, commonly used, which, as above clarified, present only the metal element and the insulating element without marking support.

These known terminals are not designed for marking and the cables must therefore be marked, irrespective of the installation mode of the terminal. This means a loss of time during wiring and marking of the electric installations.

SUMMARY OF THE INVENTION

This invention has the aim to fit each known terminal with a suitable support, apt to receive the marking elements which will identify the terminal and hence the related cable. Thus, the cable code can be directly applied as soon as the terminal is secured to the cable, without further need for marking the cable.

According to this invention, a ring fitted with a tubular extension to house a plurality of marking elements is inserted in the external insulation of the sleeve. This ring and its extension are obtained by direct injection molding on the known terminal, so as to achieve an irremovable assembly. The material forming the ring and the related expansion for the marking elements is transparent so that the marking code is visible from outside.

BRIEF DESCRIPTION OF THE DRAWINGS

The subject matter of this invention is illustrated in the enclosed drawing, in which.

Figure 7:
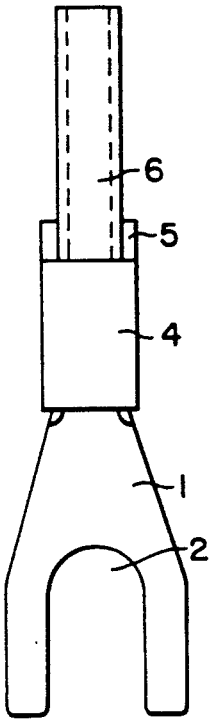
Figure 8:
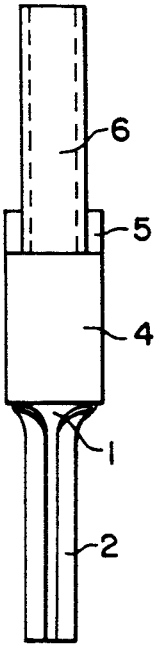
Figure 9:
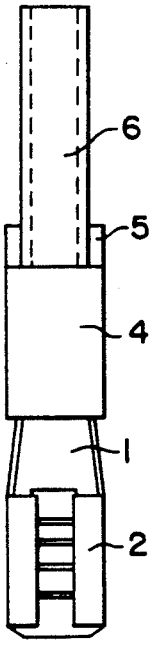

The FIGS. 7, 8, and 9 show a side elevational view of exemplified terminals according to this invention, respectively with a fork shaped, plug and Faston type end.

DETAILED DESCRIPTION OF THE PREFERRED EMBODIMENTS

Figure 1:
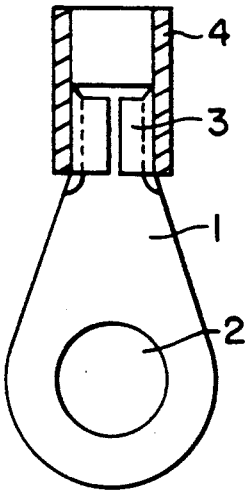
FIG. 1 shows a longitudinal sectional view of a known ring shaped terminal.
Figure 2:
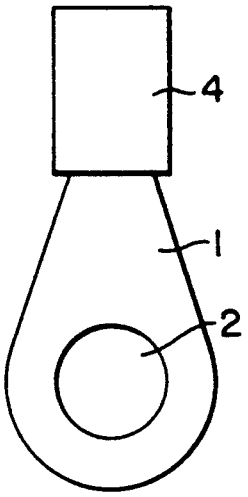
FIG. 2 shows a side elevational view of the known terminal illustrated in FIG. 1.

With reference to FIG. 1 and 2, the known terminal consists of a metal portion 1 having a shaped end 2 according to the type of connection to be made with the equipment, i.e. ring, fork, plug or Faston type. The opposite end 3 of the metal portion is ring shaped and covered by a insulating material 4, usually in non transparent and strong plastic.

According to known procedures, the end of the conductor cable from which the insulation has been removed, is threaded in the ring 3 of the metal part 1 where it is trapped by pinching the ring so as to obtain a stable joint between terminal and cable.

Figure 3:
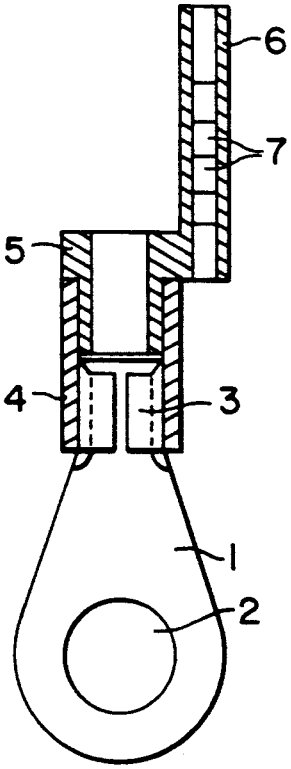
FIG. 3 shows a longitudinal sectional view of the terminal with a support for the marking elements according to this invention, placed on the plane of the coupling ring.
Figure 4:
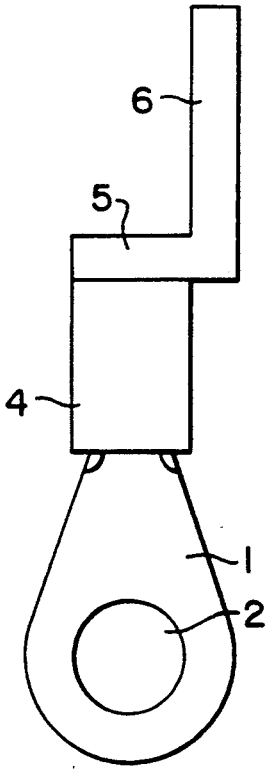
FIG. 4 shows a side elevational view of the terminal illustrated in FIG. 3.

According to the invention illustrated in FIGS. 3 and 4, a sleeve 5 featuring on one peripheral surface an extension 6, lengthwise to the terminal, in which to house the marking elements 7, is formed at the external extension of the ring shaped end 3 of the metal portion 1 and partially inside the insulating coating 4.

This sleeve 5 and its extension 6 are obtained by direct injection molding on the known terminal, so as to include all parts and form an irremovable and non-detachable assembly.

The extension 6 of the sleeve should be preferably recess shaped, i.e. as a tube in which to lodge, in known manner, the marking codes consisting of marking elements or tags 7.

This means that the extension must be transparent so that the marking elements will be clearly legible and for this reason, the whole sleeve 5 and its extension 6 are in transparent plastic material.

However, this does not exclude that the extension 6 may be ferrule shaped onto which the marking rings or tags are applied. This embodiment has, however, the drawback of not providing protection for the marking elements which may become illegible in the course of time, while on the other hand, the extension need no longer be in transparent material.

Figure 5:
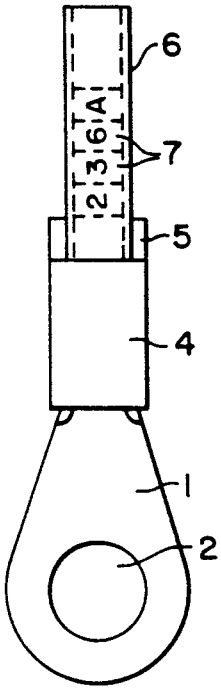
FIG. 5 shows a side elevational view of the terminal illustrated in FIG. 3 with an extension to lodge the marking elements rotated by 90° with respect to the embodiment in FIGS. 3 and 4.
Figure 6:
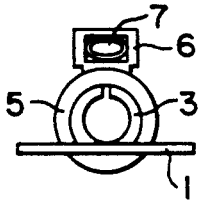
FIG. 6 shows a front elevational view of the terminal illustrated in FIG. 5.

In FIGS. 3 and 4, the extension 6 is located on one side of the terminal and on the same plane with its end 2 hooked onto the binding post, but this is only for exemplification since the extension 6 may be located anywhere with respect to the terminal. For instance, in FIGS. 5 and 6, the extension is located above the terminal at a right angle to the position illustrated in FIGS. 3 and 4.

As already explained, the end 2 of the metal part 1 of the terminal may be differently shaped according to the connection to be made and the subject matter of this invention may be directly and obviously extended to any and all ring (FIG. 5), fork (FIG. 7), plug (FIG. 8), male-female (FIG. 9) shaped and other solutions.

According to this invention, the terminal has therefore its own marker support so as to facilitate wiring of the connections and to eliminate the need for single cable or wire marking.

We claim:

1. An electrical terminal for a cable to be marked, comprising:

an electrically conductive member extending along a longitudinal axis between one end for connection to an electrical device, and an opposite end for connection to an electrical cable to be marked;

an electrically insulating, tubular coating surrounding and fixedly mounted on said opposite end of the conductive member, and having a tubular end region extending along the longitudinal axis away from said opposite end of the conductive member; and a marking sleeve having a tubular mounting portion fixedly and non-rotatably mounted within the tubular end region of the coating to constitute a non-detachable assembly, said marking sleeve being constituted of a molded synthetic plastic material and having an extension integrally molded with the sleeve, said extension extending along the longitudinal axis away from said opposite end of the conductive member.

2. The terminal according to claim 1, wherein said one end of the conductive member has a ring shape.

3. The terminal according to claim 1, wherein said one end of the conductive member has a fork shape.

4. The terminal according to claim 1, wherein said one end of the conductive member has a plug shape.

5. The terminal according to claim 1, wherein said one end of the conductive member has a plug-socket shape.

6. The terminal according to claim 1, wherein said opposite end of the conductive member has curved walls for fixedly engaging the cable to be marked.

7. The terminal according to claim 1, wherein the tubular mounting portion is coaxial with the tubular end region of the coating, said tubular mounting portion and said tubular end region both having hollow interiors for insertion of the cable to be marked.

8. The terminal according to claim 1, wherein the conductive member is radially offset from the longitudinal axis.

9. The terminal according to claim 1, wherein the conductive member has a generally planar body portion intermediate said one end and said opposite end, and wherein the extension extends in a plane generally parallel to the planar body portion.

10. The terminal according to claim 1, wherein the conductive member has a generally planar body portion intermediate said one end and said opposite end, and wherein the extension extends in a plane generally normally of the planar body portion.

11. The terminal according to claim 1, wherein the extension has an interior recess; and further comprising cable marking means mounted within the recess.

12. The terminal according to claim 11, wherein the cable marking means includes a plurality of cable marking elements, each having a code thereon.

13. The terminal according to claim 1; and further comprising cable marking means mounted on the extension.

14. The terminal according to claim 1, wherein the marking sleeve and the extension are molded of plastic material which is transparent.

15. The terminal according to claim 1, wherein the marking sleeve and the extension are molded directly on the tubular end region of the coating.

* * * * *